United States Patent [19]

Webb

[11] 4,226,902

[45] Oct. 7, 1980

[54] DECORATIVE DEVICE

[76] Inventor: Robert E. Webb, 4710 Grizzard Rd., Huntsville, Ala. 35810

[21] Appl. No.: 10,629

[22] Filed: Feb. 9, 1979

[51] Int. Cl.[2] ..... A47G 33/00

[52] U.S. Cl. ..... 428/7; D21/84; 46/87; 428/16; 428/192

[58] Field of Search ..... D21/84, 179; 40/538, 40/540, 594; 46/87, 88, 90; 428/7, 8, 12, 16, 79, 178, 192, 343, 187; 156/61

[56] References Cited

U.S. PATENT DOCUMENTS

| | | | |
|---|---|---|---|
| D. 120,339 | 5/1940 | Elder | D21/149 |
| D. 161,734 | 1/1951 | Burkes | D21/179 X |
| 2,208,445 | 7/1940 | Bates | 428/9 |
| 3,358,398 | 12/1967 | Chalfin | 40/596 |
| 3,451,882 | 6/1969 | Propoggio | 428/12 |
| 3,668,805 | 6/1972 | Coleman | 428/16X |
| 3,835,308 | 9/1974 | Reese | 40/540 |
| 3,856,609 | 12/1974 | Maas | 428/11 |
| 3,896,245 | 7/1975 | Seto et al. | 428/7 |
| 3,900,638 | 8/1975 | DuBato | 428/11 |
| 3,999,327 | 12/1976 | Immordino | 428/16 X |
| 4,037,361 | 7/1977 | Murphy et al. | 424/16 X |
| 4,076,872 | 2/1978 | Lewicki et al. | 428/12 |
| 4,101,032 | 7/1978 | Obidniak | 428/7 X |
| 4,136,412 | 1/1979 | Wilhelm | 428/178 X |

*Primary Examiner*—Henry F. Epstein
*Attorney, Agent, or Firm*—Daniel Jay Tick

[57] ABSTRACT

An inflatable gas-tight envelope has a flat sheet-like back with an edge defining the border thereof. The remainder of the envelope presents a three-dimensional item when inflated. A valve in the envelope permits selective inflation and deflation of the envelope. Adhesive on the back of the envelope in the area of the edge thereof permits the envelope to be removably affixed to a supporting surface.

7 Claims, 5 Drawing Figures

FIG. 4
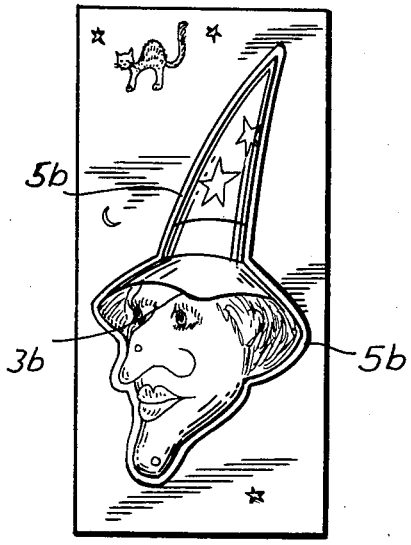
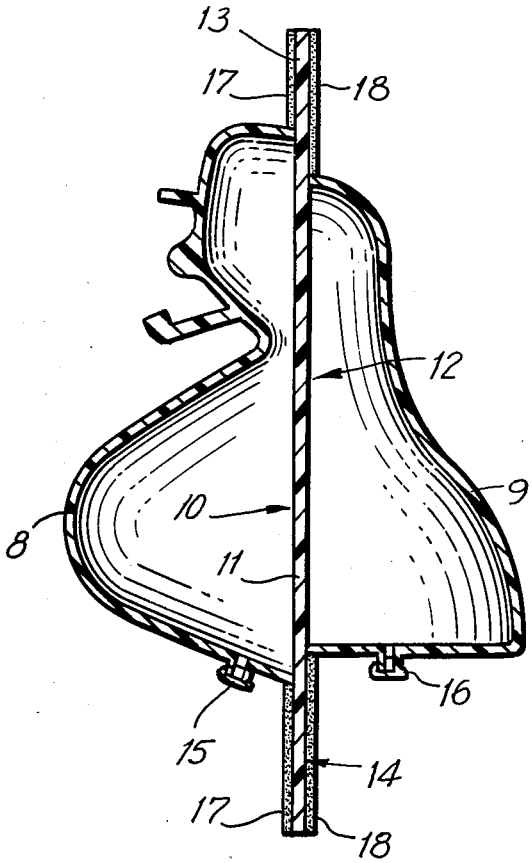
FIG. 5

DECORATIVE DEVICE

BACKGROUND OF THE INVENTION

The present invention relates to a decorative device. More particularly, the invention relates to a decorative device for decorating a supporting surface.

Families often enjoy decorating the outer door to the house or apartment in which they live on the occasion of special holidays such as, for example, Christmas, Thanksgiving, Halloween, Easter, St. Patrick's Day, and so on. The doors are decorated with colorful displays depicting scenes, symbols, and the like, associated with the particular holidays celebrated. Thus, for example, Santa Claus may appear at Christmas time, a turkey may appear at Thanksgiving time, a black cat and a pumpkin may be provided at Halloween, a bunny may be provided at Easter time, a large shamrock may be presented on St. Patrick's Day, and so on. The outer door decorations may even be provided for personal celebrations such as birthdays, anniversaries, and so on.

The principal object of the invention is to provide a decorative device which presents a three-dimensional view of a holiday or personal scene or symbol.

An object of the invention is to provide a decorative device of simple structure, which is inexpensive in manufacture, and decorates a supporting surface such as an outer door, with an attractive three-dimensional decor, as desired.

Another object of the invention is to provide a decorative device of simple structure, which is inexpensive in manufacture, mounted on a supporting surface with facility, convenience and rapidity by anyone, without skill, and functions as a pleasing attractive, pleasant colorful decoration for a holiday or personal celebration.

Still another object of the invention is to provide a decorative device of simple structure, which is mounted on a supporting surface with facility, convenience and rapidity by anyone, however unskilled, removed from a supporting surface with facility, convenience and rapidity by anyone, and stored, when not in use, in a minimum space.

BRIEF SUMMARY OF THE INVENTION

In accordance with the invention, a decorative device for decorating a supporting surface comprises an inflatable gas-tight envelope having a substantially flat sheet-like back with an edge defining the border thereof. The remainder of the envelope presents a three-dimensional item when inflated. A valve in the envelope selectively inflates and deflates the envelope. Adhesive on the back of the envelope in the area of the edge thereof removably affixes the envelope to a supporting surface.

The envelope presents an item having a holiday theme. It may be a replica of an animal, a replica of an inanimate object, or a replica of an animate object.

In accordance with the invention, another embodiment of a decorative device for decorating a supporting surface comprises a flat sheet-like back having spaced opposite first and second surfaces. A first inflatable gas-tight envelope extends from the first surface of the back with an edge therearound defining the border thereof. A second inflatable gas-tight envelope extends from the second surface of the back with an edge therearound defining the border thereof. A first valve in the first envelope selectively inflates and deflates the first envelope. A second valve in the second envelope selectively inflates and deflates the second envelope. A first adhesive on the first surface of the back in the area of the edge thereof removably affixes the back to a supporting surface when the first envelope is deflated. A second adhesive on the second surface of the back in the area of the edge thereof removably affixes the back to a supporting surface when the second envelope is deflated.

The first and second envelopes present items having first and second holiday themes, respectively.

BRIEF DESCRIPTION OF THE DRAWINGS

In order that the invention may be readily carried into effect, it will now be described with reference to the accompanying drawings, wherein:

FIG. 4 is a front view of a third embodiment of the decorative device of the invention; and FIG. 5 is a cross-sectional view of a fourth embodiment of the decorative device of the invention.

DETAILED DESCRIPTION OF THE INVENTION

Figure 1:
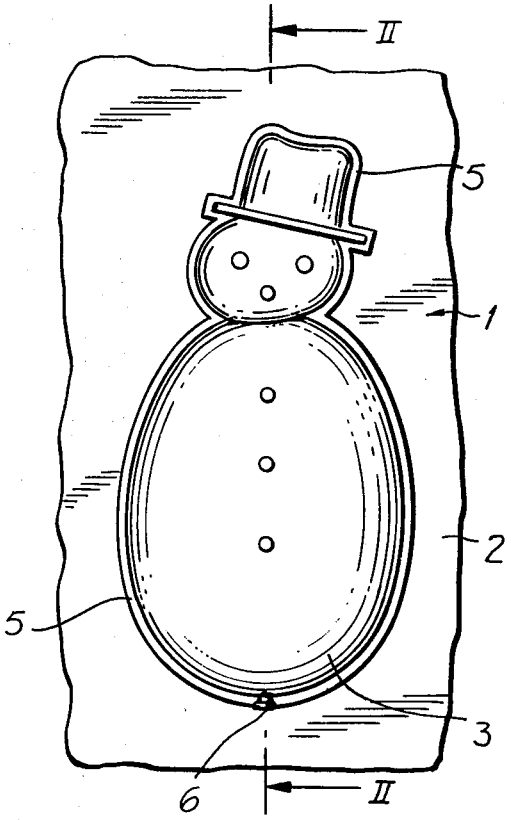
FIG. 1 is a front view of a first embodiment of the decorative device of the invention mounted on a supporting surface.
Figure 2:
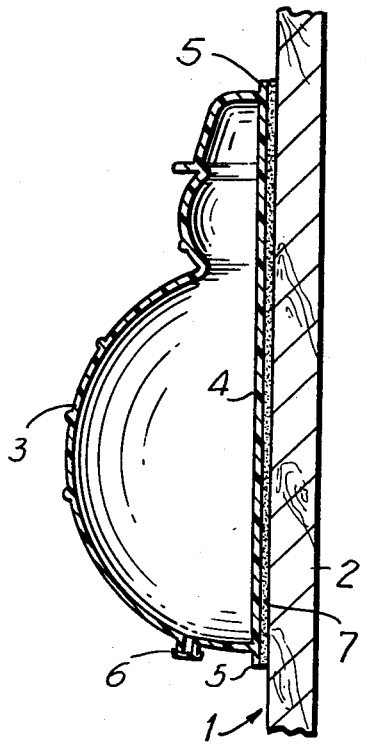
FIG. 2 is a cross-sectional view, taken along the lines II—II, of FIG. 1.

The decorative device of the invention decorates a supporting surface 1 (FIGS. 1 and 2) such as, for example, the outer surface of the door to a house, apartment, or the like. The supporting surface 1 of FIGS. 1 and 2 is the outer surface of a door 2. The supporting surface 1 may comprise any suitable surface, interior or exterior, and may consist of the inner or outer surface of the door 2.

The decorative device of the invention comprises an inflatable gas-tight envelope 3 (FIGS. 1 and 2), 3*a* (FIG. 3), or 3*b* (FIG. 4). The gas-tight envelope 3, 3*a* or 3*b* comprises any suitable gas-tight material such as, for example, plastic, rubber, or the like, and has a substantially flat sheet-like back 4, shown in FIG. 2, with an edge 5 (FIGS. 1 and 2), 5*a* (FIG. 3), or 5*b* (FIG. 4), defining the border thereof.

The envelope 3, 3*a* or 3*b*, other than the back 4 thereof, presents a three-dimensional item when inflated, as shown in FIG. 2. The edge 5, 5*a* or 5*b* provides a flat margin around the envelope.

A valve 6 (FIG. 2) is provided in the envelope 3, 3*a* or 3*b* for selectively inflating and deflating said envelope. The valve 6 may comprise any suitable valve for inflating and deflating the envelope and functions in the usual manner. It may, for example, thus be a pin type valve of the type used on automobile tires, bicycle tires, and the like. This enables the envelope to be inflated with a small hand pump, or by mouth, and permits the envelope to be deflated by depression of the pin of the valve.

Adhesive 7 (FIG. 2) is provided on the back of the envelope 3, 3*a* or 3*b* in the area of the edge 5 thereof on the flat mmargin, as shown in FIG. 2, for removably affixing the envelope to the supporting surface 1. The adhesive 7 comprises any suitable known adhesive for securing the envelope 3, 3*a* or 3*b* to the supporting surface 1 by the application of manual pressure to the edge of the envelope, and permits the removal of said envelope from said supporting surface by the application of manual pulling pressure to said edge.

The envelope 3, 3*a* or 3*b* presents an item having a holiday theme such as, for example, Santa Claus, representing Christmas, the Easter Bunny, representing Easter, a black cat, respresenting Halloween, a shamrock, representing St. Patrick's Day, and so on. The envelope may also present a personal theme such as, for example, a birthday cake, representing a personal birthday celebration.

Figure 3:
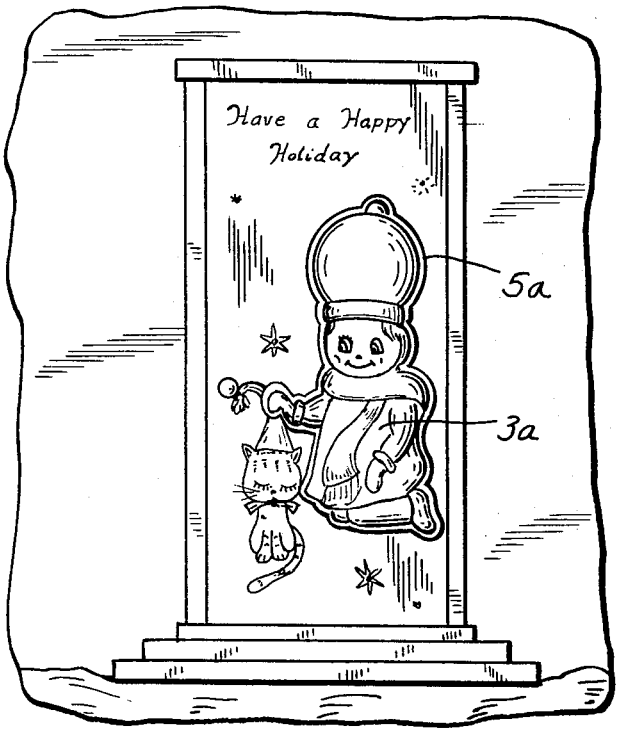
FIG. 3 is a front view of a second embodiment of the decorative device of the invention mounted on a supporting surface.

The envelope 3, 3*a* or 3*b* may be a replica of an animal such as, for example, the aforementioned Easter Bunny and black cat, a replica of an inanimate object such as, for example, a snowman, representing Christmas, as shown in FIGS. 1 and 2, or an animate object such as that of the evelope 3*a* of FIG. 3, representing Christmas, or a witch, depicted by the envelope of 3*b* in FIG. 4, representing Halloween.

The decorative device of the fourth embodiment of the invention, as shown in FIG. 5, comprises a reversible pair of different decorations, positioned back to back, so that either decoration may be displayed, as desired. The decorative device of FIG. 5 comprises a first inflatable gas-tight envelope 8 and a second inflatable gas-tight envelope 9, each comprising any suitable gas-tight material such as, for example, plastic, rubber or the like.

The first envelope 8 extends from a first surface 10 of a flat sheet-like support or back 11 consisting of plastic, rubber, or the like. The second envelope 9 extends from a spaced opposite second surface 12 of the back 11. The envelopes 8 and 9 are of smaller dimensions than those of the back 11, so that a first free edge 13 extends around the first envelope 8 on the first surface 10 and defines the border of said envelope and a second free edge 14 extends around the second envelope 9 on the second surface 12 and defines the border of said envelope. The first edge 13 provides a first flat margin around the first envelope 8, as shown in FIG. 5. The second edge 14 provides a second flat margin around the second envelope 9, as shown in FIG. 5.

Each of the envelopes 8 and 9 presents a three-dimensional item when inflated, as shown in FIG. 5. The envelope 8 presents an item having a holiday theme for a first holiday such as, for example, Christmas, and the second envelope 9 has a holiday theme for a second holiday such as, for example, New Year's. The envelopes 8 and 9 may present any desired themes, of course, in the same manner as the envelopes 3, 3*a* and 3*b*.

A valve 15 is provided in the envelope 8 and a valve 16 is provided in the envelope 9 (FIG. 5) for selectively inflating and deflating said envelopes. The valves 15 and 16 are preferably the same as the valve 6 and function in the same manner as said valve.

A first adhesive 17 is provided on the first surface 10 of the back 11 in the area of the first edge 13 thereof on the first margin (FIG. 5). A second adhesive 18 is provided on the second surface 12 of the back 11 in the area of the second edge 14 thereof on the second margin, as shown in FIG. 5. The adhesives 17 and 18 are preferably the same as the adhesive 7 and function in the same manner as the adhesive 7 to removably affix the back 11 to the supporting surface 1.

Adhesive 17 comprises any suitable known adhesive for retaining the first deflated envelope 8 next-adjacent the supporting surface 1 and supporting the second inflated envelope 9 on said supporting surface by the application of manual pressure to the edge 13 of the back 11, and permits the removal of said back and said envelopes from said supporting surface by the application of manual pulling pressure to said edge.

The adhesive 18 is the same as the adhesive 17 and retains the second deflated envelope 9 next-adjacent the supporting surface 1 and supporting the first inflated envelope 8 on said supporting surface by the application of manual pressure to the edge 14 of the back 11, and permits the removal of said back and said envelopes from said supporting surface by the application of manual pulling pressure to said edge.

The first and second envelopes 8 and 9 are thus freely reversible, as desired by the user. The user may deflate the second envelope 9, press the adhesive 18 to the supporting surface 1 and inflate the first envelope 8, so that it presents a three-dimensional Christmas decoration. Than, after Christmas, the user may deflate the first envelope 8, remove the back 11 from the supporting surface 1, press the adhesive 17 to said supporting surface, and inflate the second envelope 9, thereby providing a three-dimensional New Year's decoration.

While the invention has been described by means of specific examples and in specific embodiments, I do not wish to be limited thereto, for obvious modifications will occur to those skilled in the art without departing from the spirit and scope of the invention.

I claim:

1. A decorative device for decorating a supporting surface, said decorative device comprising
   - an inflatable gas-tight envelope having a substantially flat sheet-like back with an edge defining the border thereof, the edge providing a flat margin around the envelope, the envelope presenting a three-dimensional item when inflated;
   - valve means in said envelope for selectively inflating and deflating said envelope; and
   - adhesive means on the back of said envelope in the area of the edge thereof on the flat margin for removably affixing said envelope to a supporting surface.

2. A decorative device as claimed in claim 1, wherein the envelope presents an item having a holiday theme.

3. A decorative device as claimed in claim 1, wherein the envelope is a replica of an animal.

4. A decorative device as claimed in claim 1, wherein the envelope is a replica of an inanimate object.

5. A decorative device as claimed in claim 1, wherein the envelope is a replica of an animate object.

6. A decorative device for decorating a supporting surface, said decorative device comprising
   - a flat sheet-like back having spaced opposite first and second surfaces;
   - a first inflatable gas-tight envelope extending from the first surface of the back with a first edge therearound defining the border thereof, the first edge providing a first flat margin around the first envelope, the first envelope presenting a three-dimensional item when inflated;
   - a second inflatable gas-tight envelope extending from the second surface of the back with a second edge therearound defining the border thereof, the second edge providing a second flat margin around the second envelope, the second envelope presenting a three-dimensional item when inflated;

first valve means in said first envelope for selectively inflating and deflating said first envelope;

second valve means in said second envelope for selectively inflating and deflating said second envelope;

first adhesive means on the first surface of the back in the area of the first edge thereof on the first flat margin for removably affixing said back to a supporting surface when said first envelope is deflated; and second adhesive means on the second surface of said back in the area of the second edge thereof on the second flat margin for removably affixing said back to a supporting surface when said second envelope is deflated.

7. A decorative device as claimed in claim 6, wherein the first and second envelopes present items having first and second holiday themes, respectively.

* * * * *